US011066951B2

(12) United States Patent
Biolsi et al.

(10) Patent No.: US 11,066,951 B2
(45) Date of Patent: Jul. 20, 2021

(54) WEAR LINER FOR FIXED STATOR VANES

(71) Applicant: UNITED TECHNOLOGIES CORPORATION, Hartford, CT (US)

(72) Inventors: David Biolsi, Portland, ME (US); Thomas Freeman, Kennebunk, ME (US)

(73) Assignee: Raytheon Technologies Corporation, Farmington, CT (US)

( * ) Notice: Subject to any disclaimer, the term of this patent is extended or adjusted under 35 U.S.C. 154(b) by 601 days.

(21) Appl. No.: 15/135,214

(22) Filed: Apr. 21, 2016

(65) Prior Publication Data

US 2017/0306791 A1 Oct. 26, 2017

(51) Int. Cl.

| | |
|---|---|
| ***F01D 11/00*** | (2006.01) |
| ***F01D 25/00*** | (2006.01) |
| ***F01D 9/04*** | (2006.01) |
| ***F01D 25/24*** | (2006.01) |

(52) U.S. Cl.

CPC ..... *F01D 25/007* (2013.01); *F01D 9/042* (2013.01); *F01D 25/246* (2013.01); *F01D 11/005* (2013.01); *F05D 2250/75* (2013.01); *F05D 2260/95* (2013.01)

(58) Field of Classification Search

CPC ..... F01D 9/042; F01D 25/246; F01D 25/007
See application file for complete search history.

(56) References Cited

U.S. PATENT DOCUMENTS

| | | | | |
|---|---|---|---|---|
| 5,749,218 | A | 5/1998 | Cromer et al. | |
| 8,714,915 | B2 * | 5/2014 | Blatchford | F01D 25/00 415/121.2 |
| 9,062,553 | B2 * | 6/2015 | Baumas | F01D 9/042 |
| 9,353,649 | B2 * | 5/2016 | Rioux | F01D 25/246 |
| 2008/0053107 | A1 | 3/2008 | Weaver et al. | |
| 2012/0128481 | A1 | 5/2012 | Baumas | |
| 2014/0241874 | A1 | 8/2014 | Rioux | |

FOREIGN PATENT DOCUMENTS

| | | |
|---|---|---|
| DE | 102007059220 | 6/2009 |
| EP | 2612998 | 7/2013 |
| GB | 2477825 | 8/2011 |

OTHER PUBLICATIONS

European Patent Office, European Search Report dated Dec. 13, 2017 in Application No. 17157173.0-1610.
European Patent Office, European Search Report dated Feb. 26, 2019 in Application No. 17157173.0.
European Patent Office, European Search Report dated Nov. 21, 2019 in Application No. 17157173.0.
European Patent Office, European Office Action dated Jul. 17, 2020 in Application No. 17157173.0.

* cited by examiner

*Primary Examiner* — Woody A Lee, Jr.
*Assistant Examiner* — Sabbir Hasan
(74) *Attorney, Agent, or Firm* — Snell & Wilmer L.L.P.

(57) ABSTRACT

The present disclosure provides a wear liner for a stator vane that has a first hook and a second hook that are connected by a base, providing in a generally S-shaped channel. The wear liner includes an outer surface that is adapted to lie against a first component and an inner surface that is adapted to lie against a second component. The first hook of the wear liner includes a first engaging end that is adapted to engage a first component, while the second hook is adapted to engage the second component. The first component may comprise a vane foot and the second component may comprise a slot for receiving and securing the vane foot.

13 Claims, 7 Drawing Sheets

WEAR LINER FOR FIXED STATOR VANES

GOVERNMENT LICENSE RIGHTS

This invention was made with government support under N00019-02-C-3003 awarded by United States Air Force. The government has certain rights in the invention.

FIELD OF THE DISCLOSURE

The subject matter disclosed herein relates generally to wear liners.

BACKGROUND OF THE DISCLOSURE

A gas turbine engine typically includes a fan, a compressor, a combustor and a turbine. Stator airfoils are supported on features defined within an inner case. The features typically include grooves or slots that receive flanges known as feet or hooks. The fit of the feet within the grooves of the inner case are typically a clearance fit that accommodates relative thermal growth during operation. The relative movement can cause wear as well as provide an undesired leak path. The tight tolerances make assembly and manufacture difficult while also increasing costs.

SUMMARY OF THE DISCLOSURE

In various embodiments, a wear liner is disclosed that comprises a first hook and a second hook connected by a base to provide a generally S-shaped channel. The wear liner includes an outer surface adapted to lie against a first component and an inner surface adapted to lie against a second component. A first engaging end of the first hook is adapted to engage the first component and a second engaging end of the second hook is adapted to engage the second component.

In various embodiments, the first component is a vane foot and the second component is a slot. Also, the first engaging end comprises a curve intersecting a surface of the vane foot and the second engaging end comprises a curve intersecting a narrow portion of a slot. The wear liner may comprise a single sheet of material.

In various embodiments, the wear liner is manufactured by bending a stripped material to form a first hook and a second hook. A base connects the first hook and the second hook, which forms a generally S-shaped channel. The S-shaped channel has an outer surface that is formed to lie against a first component and an inner surface that is adapted to lie against a second component. A first engaging end of the first hook is formed to press against and seal to the first component and a second engaging end of the second hook is formed to press against and seal to the second component.

In various embodiments, the wear liner is installed within a gas turbine engine by inserting the wear liner into an inner diameter of a fan case. One of ordinary skill in the art will appreciate that while the wear liner is described relative to specific implementations (e.g., a fan case), this is for explanation only. The wear liner may be configured with little or no modification, to be suitably implemented within a number of varying modules and components for a gas turbine engine. Moreover, while generally described in the context of a gas turbine engine, the application for the disclosed wear liner is not so limited. The wear liner may be implemented in any application having a foot and hook configuration similar to what is disclosed herein.

The wear liner includes a first hook and a second hook that are connected by a base to provide a generally S-shaped channel. An outer surface of the wear liner is pressed against a first component and an inner surface is pressed against a second component. A first engaging end of the first hook engages the first component and a second engaging end of the second hook engages the second component.

In various embodiments, the wear liner is inserted as a 360° coil. The wear liner may also comprises a first 180° section and a second 180° section that are inserted end-to-end to form a 360° coil. The first engaging end of the first hook is formed to include a curve intersecting a surface of a vane foot and the second engaging end is formed to include a curve intersecting a narrow portion of a slot. The wear liner may be installed as a single sheet of material.

In various embodiments, the disclosed wear liner comprises a single surface, thereby reducing loose fits as may occur in a dual surface wear liner configuration. The disclosed wear liner may increase tolerance to a stator and case interface over a typical dual surface configuration. In contrast, a dual surface wear liner may significantly increase this tolerance due being configured to wrap around both inner and outer diameters of a case groove.

BRIEF DESCRIPTION OF THE DRAWINGS

The accompanying drawings are included to provide a further understanding of the present disclosure and are incorporated in, and constitute a part of, this specification, illustrate various embodiments, and together with the description, serve to explain the principles of the disclosure.

DETAILED DESCRIPTION

The detailed description of various embodiments herein makes reference to the accompanying drawings, which show various embodiments by way of illustration. While these various embodiments are described in sufficient detail to enable those skilled in the art to practice the disclosure, it should be understood that other embodiments may be realized and that logical, chemical, and mechanical changes may be made without departing from the spirit and scope of the disclosure. Thus, the detailed description herein is presented for purposes of illustration only and not of limitation.

The steps recited in any of the method or process descriptions may be executed in any order and are not necessarily limited to the order presented. Furthermore, any reference to singular includes plural embodiments, and any reference to more than one component or step may include a singular embodiment or step. Also, any reference to attached, fixed, connected, or the like may include permanent, removable, temporary, partial, full, and/or any other possible attachment option. Additionally, any reference to without contact (or similar phrases) may also include reduced contact or minimal contact.

For example, in the context of the present disclosure, systems and methods may find particular use in connection with a half wear liner that protects the inside surface of a fan case. However, various aspects of the disclosed embodiments may be adapted for optimized performance with a variety of turbine assemblies. As such, numerous applications of the present disclosure may be realized.

An X-Y-Z coordinate system is shown in FIGS. 1-4 for spacial reference purposes, with the orthogonal X and Y-axes defining a horizontal X-Y plane to which the Z-axis is perpendicular. As used herein, the term "vertically extending" includes exactly vertical (i.e., exactly parallel to the Z-axis) and approximately vertical (i.e., approximately parallel to the Z-axis), while the term "horizontally extending" includes exactly horizontal (i.e., exactly parallel to the X-Y plane) and approximately horizontal (i.e., approximately parallel to the X-Y plane).

As used herein, terms such as "under", "below", "on-top", "above", etc., may be used in describing relative position along the axis, with on top and above reflecting positive Z displacement and under and below reflecting negative Z displacement.

Figure 1:
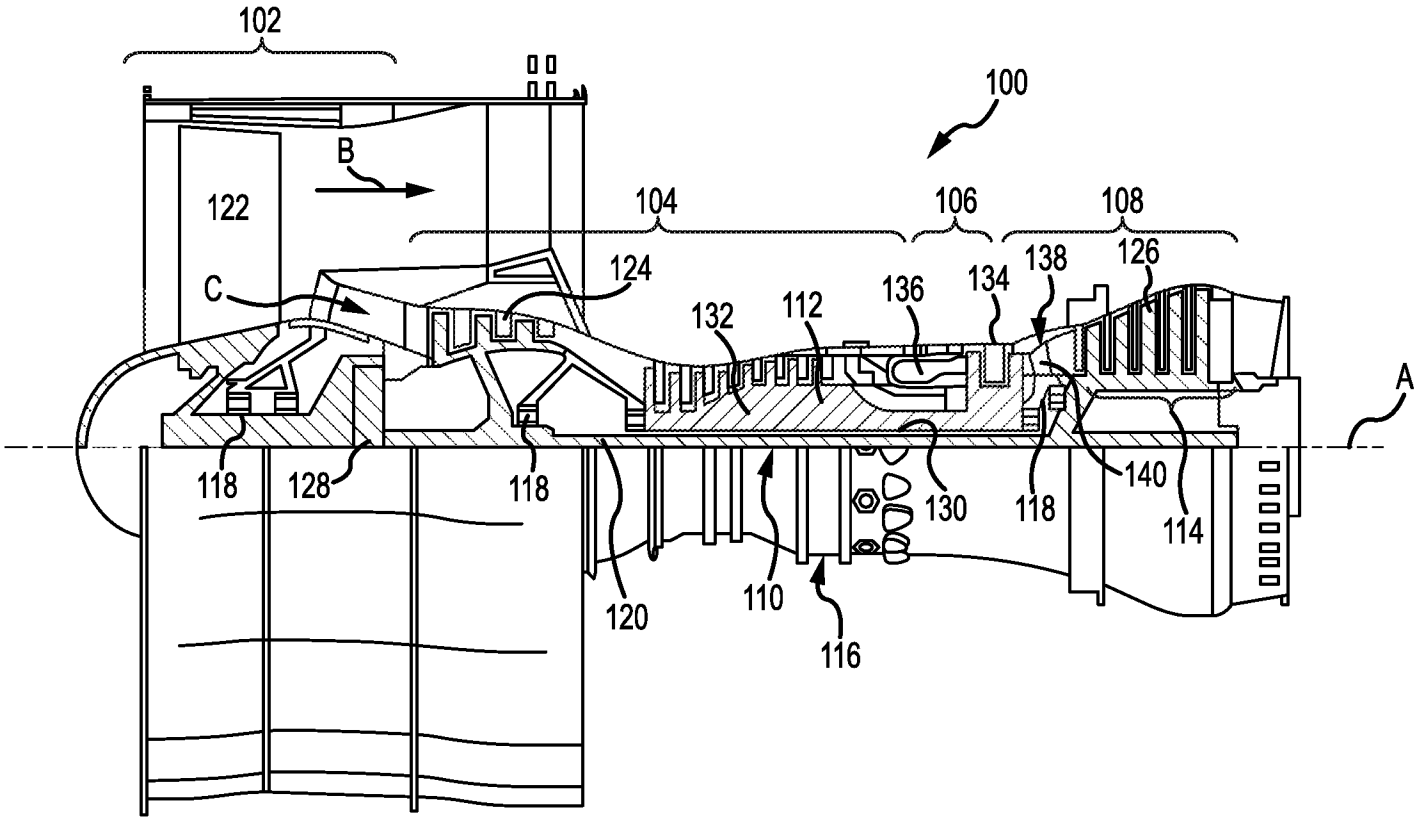
FIG. 1 is a schematic view of an example gas turbine engine in accordance with various embodiments.

FIG. 1 schematically illustrates an example gas turbine engine 100 that includes a fan 102, a compressor 104, a combustor 106 and a turbine 108. Alternative engines might include an augmenter (not shown) among other systems or features. The fan 102 drives air along a bypass flow path B while the compressor 104 draws air in along a core flow path C where air is compressed and communicated to a combustor 106. In the combustor 106, air is mixed with fuel and ignited to generate a high-pressure exhaust gas stream that expands through the turbine 108 where energy is extracted and utilized to drive the fan 102 and the compressor 104.

Although the disclosed embodiments frequently depict a turbofan gas turbine engine, it should be understood that the concepts described herein are not limited to use with turbofans.

The example gas turbine engine 100 generally includes a low-speed spool 110 and a high-speed spool 112 mounted for rotation about an engine central longitudinal axis A relative to an engine static structure 116 via bearing systems 118. It should be understood that bearing systems 118 at various locations may alternatively or additionally be provided.

The low-speed spool 110 generally includes an inner shaft 120 that connects a fan 122 and a low-pressure compressor 124 to a low-pressure turbine 126. The inner shaft 120 drives the fan 122 through a speed change device, such as a geared architecture 128, to drive the fan 122 at a lower speed than the low-speed spool 110. The high-speed spool 112 includes an outer shaft 130 that interconnects a high-pressure compressor 132 and a high-pressure turbine 134. The inner shaft 120 and the outer shaft 130 are concentric and rotate via the bearing systems 118 about the engine central longitudinal axis A.

A combustor 136 is arranged between the high-pressure compressor 132 and the high-pressure turbine 134. In one example, the high-pressure turbine 134 includes at least two stages to provide a double stage type of high-pressure turbine 134. In another example, the high-pressure turbine 134 includes only a single stage. As used herein, a "high-pressure" compressor or turbine experiences a higher pressure than a corresponding "low-pressure" compressor or turbine.

In various embodiments, low-pressure turbine 126 has a pressure ratio that is greater than about 5. The pressure ratio of the example low-pressure turbine 126 is measured prior to an inlet of the low-pressure turbine 126 as related to the pressure measured at the outlet of the low-pressure turbine 126 prior to an exhaust nozzle.

A mid-turbine frame 138 of the engine static structure 116 is arranged generally between the high-pressure turbine 134 and the low-pressure turbine 126. The mid-turbine frame 138 further supports having bearing systems 118 in the turbine 108 as well as setting airflow entering the low-pressure turbine 126.

The core airflow C is compressed by the low-pressure compressor 124 then by the high-pressure compressor 132 mixed with fuel and ignited in the combustor 136 to produce high speed exhaust gases that are then expanded through the high-pressure turbine 134 and low-pressure turbine 126. The mid-turbine frame 138 includes a plurality of stator vane 140, which are in the core airflow path and function as an inlet guide vane for the low-pressure turbine 126. Utilizing the stator vane 140 of the mid-turbine frame 138 as the inlet guide vane for low-pressure turbine 126 decreases the length of the low-pressure turbine 126 without increasing the axial length of the mid-turbine frame 138. Reducing or eliminating the number of vanes in the low-pressure turbine 126 shortens the axial length of the turbine 108. Thus, the compactness of the gas turbine engine 100 is increased and a higher power density may be achieved.

In various embodiments, the gas turbine engine 100 is a high-bypass geared aircraft engine. The gas turbine engine 100 includes a bypass ratio greater than about six (6), with an example embodiment being greater than about ten (10). The example geared architecture 128 is an epicyclical gear train, such as a planetary gear system, star gear system or other known gear system, with a gear reduction ratio of greater than about 2.3.

In one disclosed embodiment, the gas turbine engine 100 includes a bypass ratio greater than about ten (10:1) and the fan diameter is significantly larger than an outer diameter of the low-pressure compressor 124. It should be understood, however, that the above parameters are only exemplary of one embodiment of a gas turbine engine including a geared architecture and that the present disclosure is applicable to other gas turbine engines.

The example gas turbine engine includes a fan 122 that comprises less than about twenty-six (26) fan blades. In various embodiments, the fan 102 includes less than about twenty (20) fan blades. Moreover, the low-pressure turbine 126 includes no more than about six (6) turbine rotors schematically indicated at 114. In various embodiments, the low-pressure turbine 126 includes about three (3) turbine rotors. A ratio between a number of blades of fan 122 and the number of low-pressure turbine rotors is between about 3.3 and about 8.6.

Figure 2:
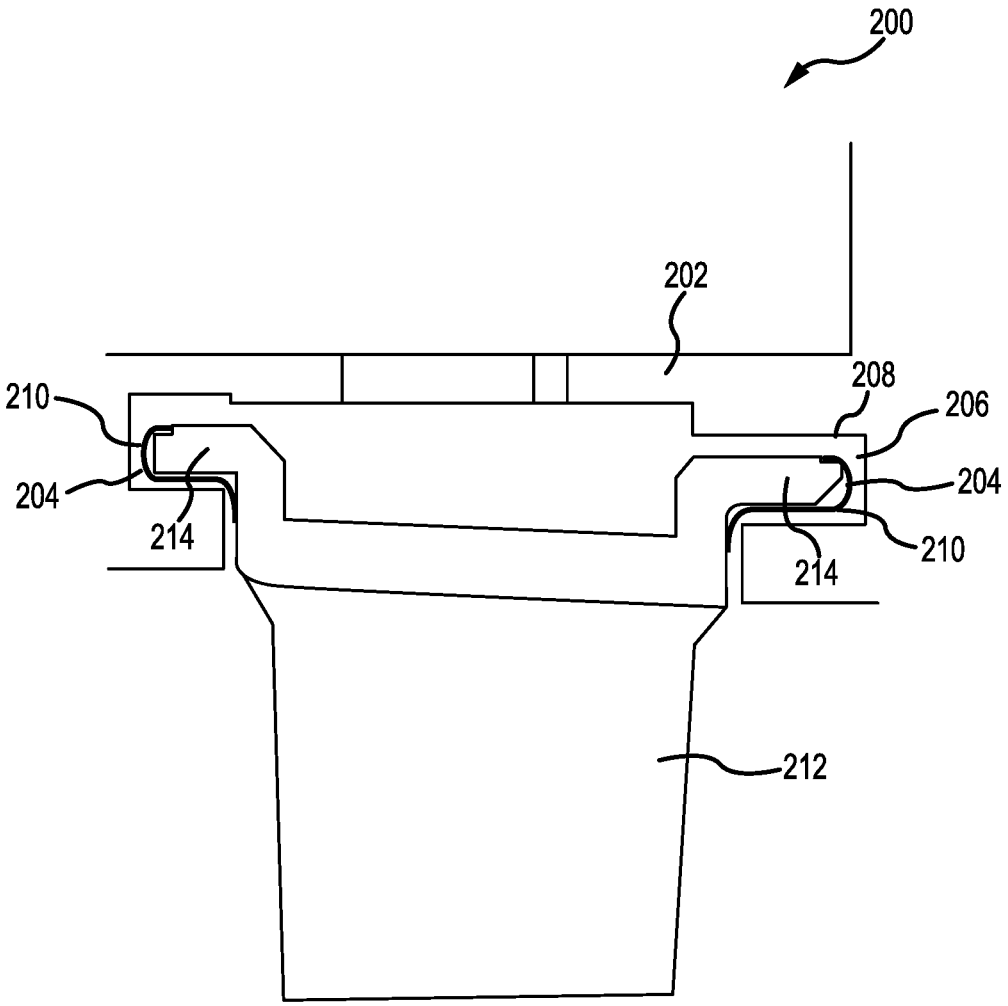
FIG. 2 is a section view of a stator vane mounted within a case structure in accordance with various embodiments.

Referring to FIG. 2, a stator section 200 of the example gas turbine engine 100 includes a stator vane 212 having a vane foot 214 that is received within slot 204 defined within a case 202. In this example, the case 202 provides the support for the stator vane 212 within corresponding slot 204. The vane foot 214 is received within the slot 204 of the case 202. The slot 204 includes an outside facing side of surface 208 with a groove 206. To allow slot 204 to secure the vane foot 214, slot 204 further includes a narrow portion on a side that is open in the direction of stator vane 212.

In various embodiments, a wear liner 210 is disposed between the vane foot 214 and the inner surfaces of the slot 204. The wear liner 210 is axially installed and provides wear protection for the inner diameter (ID) of the fan case. More particularly, the wear liner 210 provides wear protection to slot 204 along with the vane foot 214, to prevent fretting and/or galling.

Figure 3:
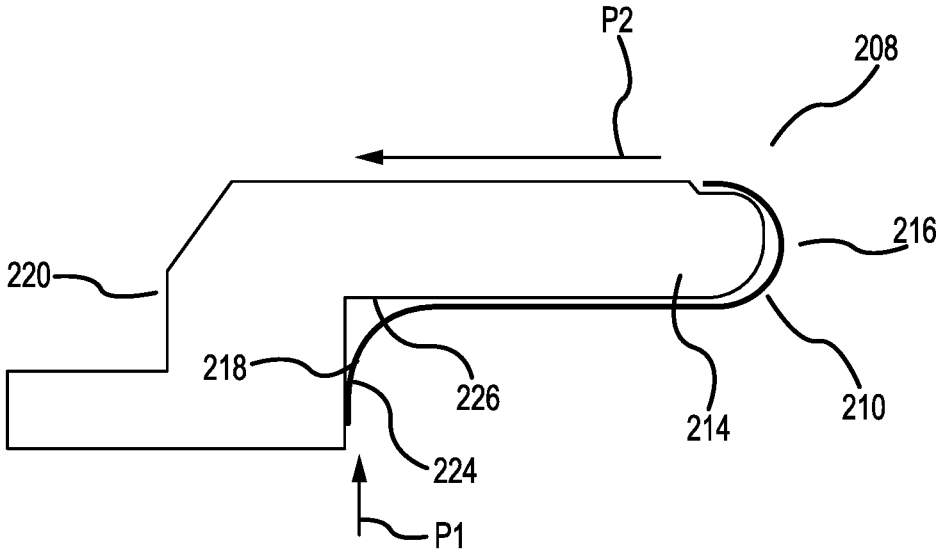
FIG. 3 is an enlarged view of one stator vane foot in accordance with various embodiments.
Figure 4:
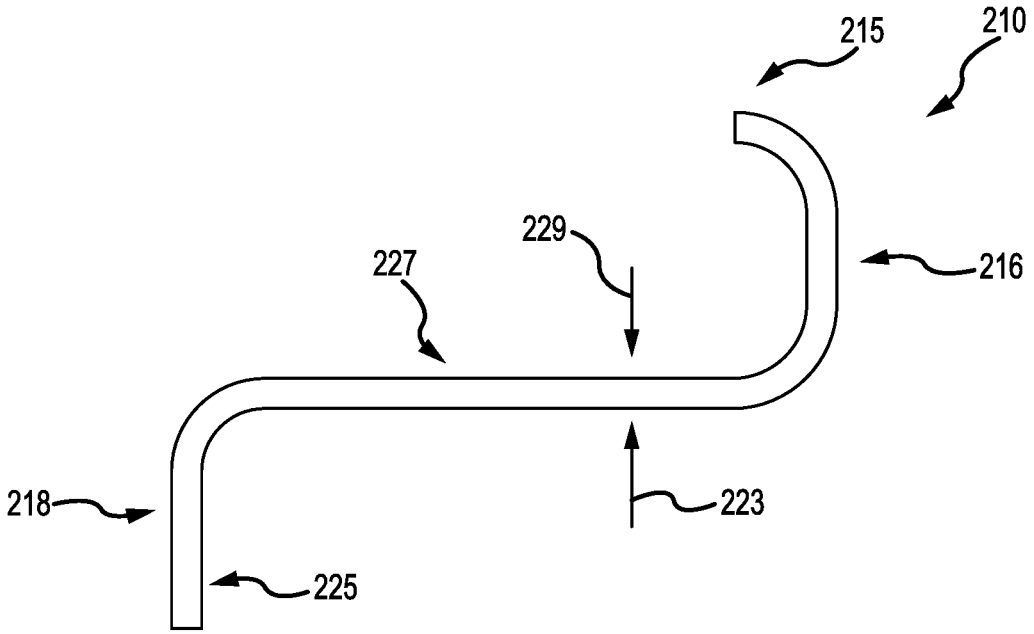
FIG. 4 is a cross-sectional view of wear liner in accordance with various embodiments.

Referring to FIGS. 3 and 4, with continued reference to FIG. 2, the wear liner 210 includes a first hook 216 that receives the vane foot 214. The first hook 216 is disposed about a foot end 215. The second hook 218 includes a curved surface 227 that terminates with a second engaging end 225 that intersects and engages slot 226, which is a transverse surface of the vane foot 214.

The contact between a foot surface 224 of the vane foot 214 and the second hook 218 of the wear liner 210 provides a sealing contact between the wear liner 210 and the vane foot 214.

In various embodiments, material properties of the sheet utilized to form the disclosed wear liner 210 are compatible with the temperatures and pressures encountered during operation. The sheet may comprise any material having attributes that may be desired and/or critical for the specific wear liner implementation. The sheet may comprise any suitable metal, ceramic, mineral, or plastic. Further, the surface finish of the wear liner 210 is such that the desired contact seal is formed with the inside-facing side of surface 208 of the slot 204 and the surface of the vane foot 214. Moreover, it is contemplated that the wear liner 210 may include a coating to further inhibit wear and provide the desired sealing properties. Coatings typically used in the aerospace industry are known among those of ordinary skill in the art. Coatings that might be well-suited for various applications may include thermal spray coatings, ceramic coatings, cermet coatings, abradable coatings, etc.

Referring to FIG. 4, the wear liner 210 for a vane foot includes a first hook 216 and a second hook 218 connected by a base 227 to form a generally S-shaped channel. The wear liner 210 has an outer surface 229 adapted to lie against a first component, which includes a slot that is configured to secure a vane foot. An inner surface 223 is adapted to lie against a second component, such as a vane foot that is positioned in a slot. A first engaging end 215 of the first hook 216 is adapted to engage the first component and a second engaging end 225 of the second hook 218 is adapted to engage the second component. The first engaging end 215 defines a terminus (also referred to herein as a first terminus) of the wear liner 210. The second engaging end 225 defines a terminus (also referred to herein as a second terminus) of the wear liner 210. Said first terminus is at an opposite end of the wear liner 210 from said second terminus.

Figure 5:
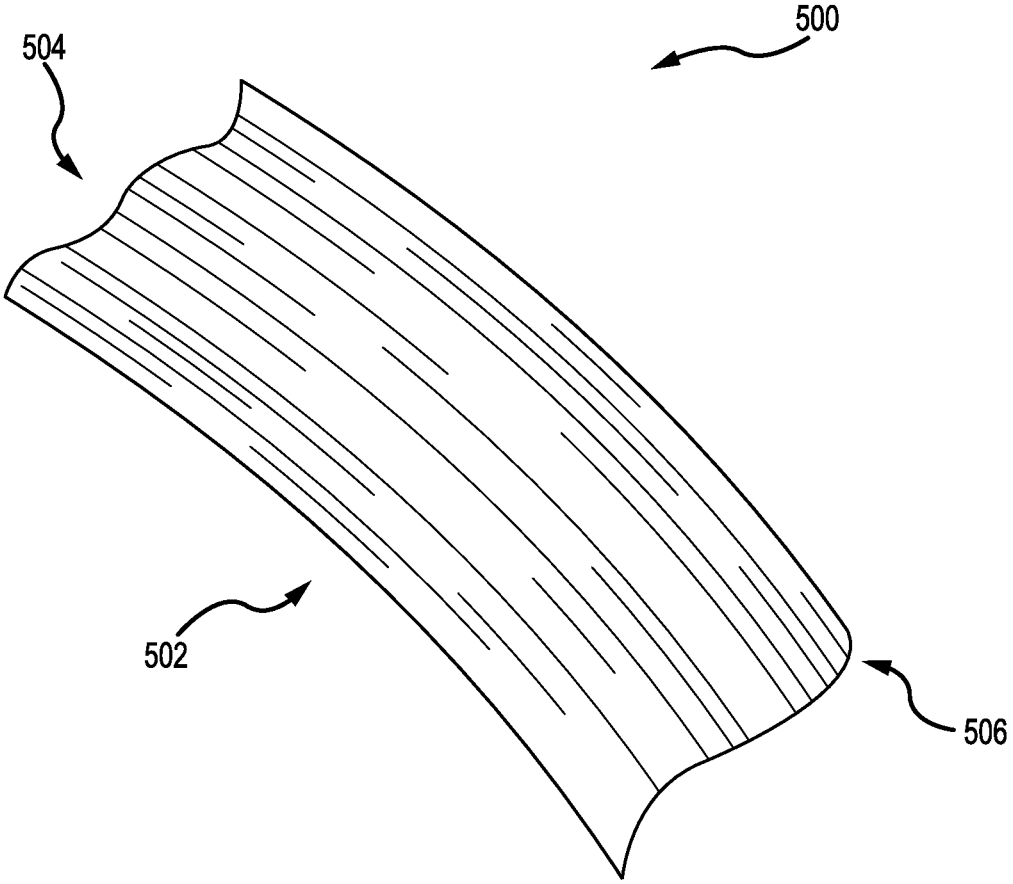
FIG. 5 is a perspective view of a wear liner section in accordance with various embodiments.

Referring to FIG. 5, in various embodiments, the wear liner 500 includes an integral single sheet 502 construction. The integral single sheet 502 construction provides a continuous length of the wear liner 500 that may be cut in accordance with its intended installation. Constructing a single piece of material having bends 504, 506 as disclosed herein, eliminates or minimizes joints that may be formed by welding or through use of adhesives to secure the wear liner 500.

In various embodiments, the wear liner 500 is constructed through a progressive fabrication process that use press brakes to coin or air-bend stripped material into the shapes described herein, relative to various embodiments. In various embodiments, a stripped material is formed in accordance with the precise bends, angles, and dimensions of a specific gas turbine engine.

In various embodiments, the shape of the disclosed wear liner 500 is formed by way of a series of in-line rollers that progressively bend the stripped material as it is moved through a series of inline rollers. The rollers cause the stripped material to coil to a precise curvature, which simplifies installation and ensures a proper seal between the finished wear liner and a vane foot.

In various embodiments, the wear liner 500 is cut from a coil according to the precise application properties. For example, a continuous coil may be cut to lengths forming a 180° coil (e.g., half of the radius of a fan) or a full 360° coil. It is contemplated that a manufacturing process may produce a wear liner 500 coil having any finished size, radius, or length. For example, the disclosed wear liner 500 may be produced in six (6) 60° segments for portability, wherein the segments are attached end-to-end prior to installation. In various embodiments, multiple segments that together comprise a full 360° wear liner 500, may each be installed individually.

Figure 6:
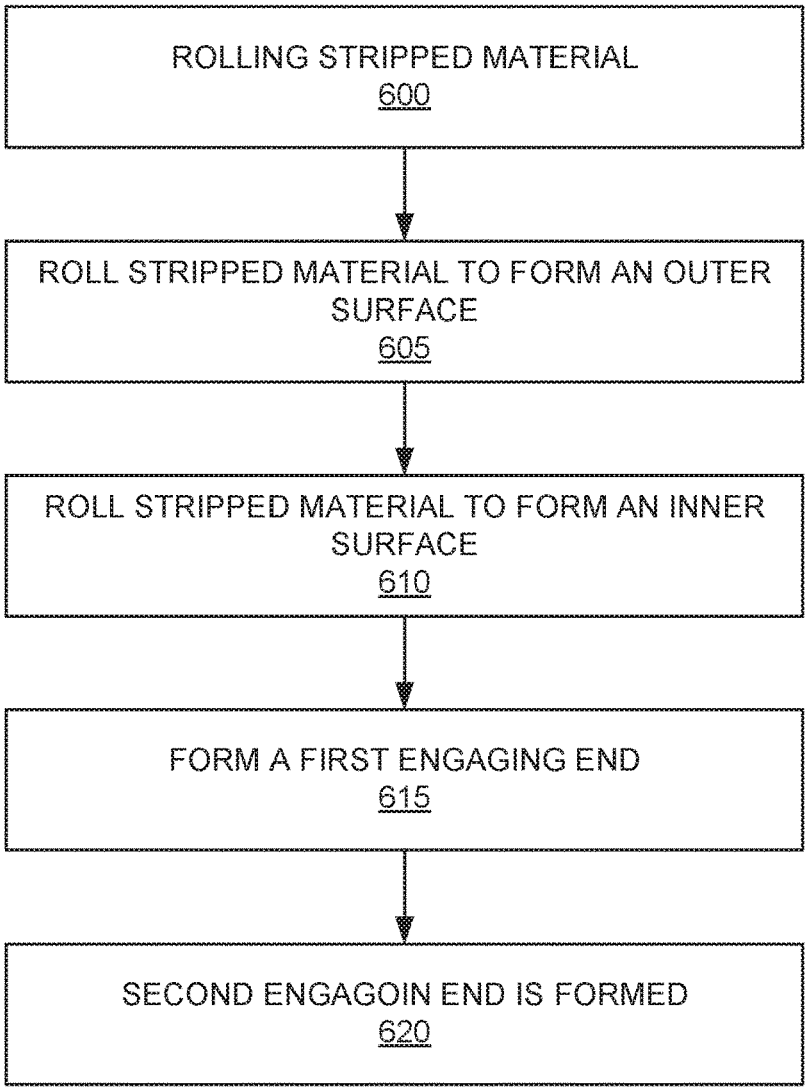
FIG. 6 is a process flow showing steps for manufacturing a wear liner in accordance with various embodiments.

FIG. 6 is a process flow showing steps for manufacturing a wear liner in accordance with various embodiments. A manufacturing process may include rolling a stripped material (step 600) to form a first hook and a second hook connected by a base to form a generally S-shaped channel. Stripped material is rolled to form an outer surface (step 605) to lie against a first component (i.e., vane foot) the outer surface including a first engaging end. Stripped material is further rolled to form an inner surface (step 610) to lie against a second component (i.e., slot).

Manufacturing may further include forming a first engaging end (step 615) of the first hook to seal to the first component vane foot. A second engaging end is formed (step 620) of the second hook to seal to the slot.

Figure 7:
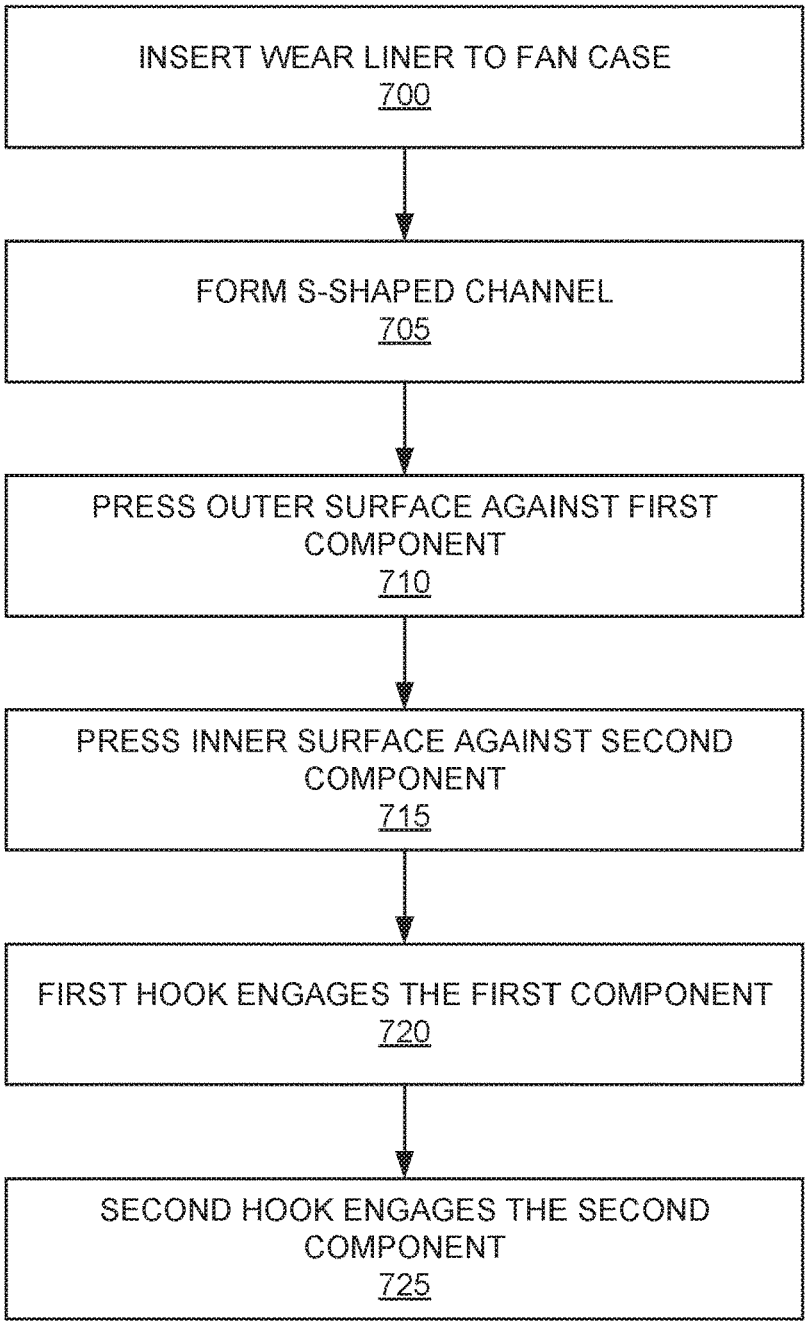
FIG. 7 is a process flow showing steps for installing a wear liner in accordance with various embodiments.

FIG. 7 is a process flow showing steps for installing a wear liner in accordance with various embodiments. Installing the wear liner may include inserting the wear liner into an inner diameter of a fan case (step 700), the wear liner comprising a first hook and a second hook connected by a base to provide a generally S-shaped channel (step 705), the wear liner having an outer surface pressed against a first component (i.e., vane foot) (step 710) and an inner surface pressed against a second component (i.e., slot) (step 715), a first engaging end of the first hook engaging the first component (i.e., vane foot) (step 720) and a second engaging end of the second hook engaging the second component (i.e., slot) (step 725).

Benefits, other advantages, and solutions to problems have been described herein with regard to specific embodiments. Furthermore, the connecting lines shown in the various figures contained herein are intended to represent exemplary functional relationships and/or physical couplings between the various elements. It should be noted that many alternative or additional functional relationships or physical connections may be present in a practical system. However, the benefits, advantages, solutions to problems, and any elements that may cause any benefit, advantage, or solution to occur or become more pronounced are not to be construed as critical, required, or essential features or elements of the disclosure. The scope of the disclosure is accordingly to be limited by nothing other than the appended claims, in which reference to an element in the singular is not intended to mean "one and only one" unless explicitly so stated, but rather "one or more." Moreover, where a phrase similar to "at least one of A, B, or C" is used in the claims, it is intended that the phrase be interpreted to mean that A alone may be present in an embodiment, B alone may be present in an embodiment, C alone may be present in an embodiment, or that any combination of the elements A, B and C may be present in a single embodiment; for example, A and B, A and C, B and C, or A and B and C. Different cross-hatching is used throughout the figures to denote different parts but not necessarily to denote the same or different materials.

Devices and methods are provided herein. In the detailed description herein, references to "one embodiment", "an embodiment", "various embodiments", etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described. After reading the description, it will be apparent to one skilled in the relevant art(s) how to implement the disclosure in alternative embodiments.

Furthermore, no element, component, or method step in the present disclosure is intended to be dedicated to the public regardless of whether the element, component, or method step is explicitly recited in the claims. No claim element herein is to be construed under the provisions of 35 U.S.C. 112(f) unless the element is expressly recited using the phrase "means for." As used herein, the terms "comprises", "comprising", or any other variation thereof, are intended to cover a non-exclusive inclusion, such that a process, method, article, or apparatus that comprises a list of elements does not include only those elements but may include other elements not expressly listed or inherent to such process, method, article, or apparatus.

What is claimed is:

1. An assembly comprising:

a vane foot comprising a forward end, an aft end, and a recess on at least one of the forward end and the aft end; and a wear liner for the vane foot, the wear liner comprises a sheet of material comprising a first hook and a second hook connected by a base;

wherein the first hook comprises a first engaging end and the second hook comprises a second engaging end;

the first engaging end defines a first terminus of the sheet of material and the second engaging end defines a second terminus of the sheet of material, and the first terminus is opposite the second terminus;

the sheet of material comprises an outer surface adapted to lie against the vane foot, the first engaging end of the first hook configured to press against, and seal to the vane foot;

the first hook is configured to receive the vane foot;

the first engaging end comprises a first curve and extends into the recess, and the first engaging end terminates at the recess.

2. The assembly of claim 1, wherein the sheet of material comprises a single sheet.

3. The wear liner of claim 1, wherein the first hook is disposed about the vane foot.

4. The assembly of claim 1, wherein the wear liner further comprises an inner surface adapted to lie against a second component, the second engaging end of the second hook is configured to press against and seal to the second component.

5. The assembly of claim 4, wherein the second component is a case including a slot.

6. The assembly of claim 5, wherein the second engaging end comprises a second curve intersecting the slot.

7. The assembly of claim 1, wherein the first engaging end extends in a first direction and the second engaging end extends in a second direction perpendicular to the first direction.

8. A method of installing a wear liner within a gas turbine engine comprising:

inserting the wear liner into an inner diameter of a fan case, the wear liner comprising a sheet of material comprising a first hook and a second hook connected by a base;

wherein the first hook comprises a first engaging end and the second hook comprises a second engaging end;

the first engaging end defines a first terminus of the sheet of material and the second engaging end defines a second terminus of the sheet of material, and the first terminus is opposite from the second terminus;

the wear liner having an outer surface pressed against a vane foot, the first engaging end of the first hook engaging the vane foot;

the first engaging end terminates at the vane foot;

the vane foot is received by the first hook;

the vane foot comprises a forward end, an aft end, and a recess on at least one of the forward end and the aft end;

the first engaging end comprises a first curve and extends into the recess, and the first engaging end terminates at the recess.

9. The method of claim 8, wherein the sheet of material is formed from a single sheet.

10. The method of claim 8, wherein the wear liner further comprises an inner surface pressed against a second component, wherein the second engaging end of the second hook is engaging the second component.

11. The method of claim 10, wherein the second component is a case including a slot.

12. The method of claim 11, wherein the second engaging end is formed to include a second curve intersecting the slot.

13. The method of claim 8, wherein the first engaging end extends in a first direction and the second engaging end extends in a second direction perpendicular to the first direction.

* * * * *